United States Patent [19]

McComas

[11] Patent Number: 4,889,589

[45] Date of Patent: Dec. 26, 1989

[54] GASEOUS REMOVAL OF CERAMIC COATINGS

[75] Inventor: Charles C. McComas, Stuart, Fla.

[73] Assignee: United Technologies Corporation, Hartford, Conn.

[21] Appl. No.: 180,594

[22] Filed: Apr. 11, 1988

Related U.S. Application Data

[63] Continuation of Ser. No. 878,720, Jun. 26, 1986, abandoned.

[51] Int. Cl.[4] ..... C03C 15/00

[52] U.S. Cl. ..... 156/646; 156/656; 156/664; 156/667; 134/3; 134/37; 427/307; 29/402.04

[58] Field of Search ..... 156/645, 646, 647, 656, 156/664, 667, 662, 668, 657; 134/3, 11, 19, 21, 31, 37; 427/307; 252/79.3; 29/402.04, 402.06

[56] References Cited

U.S. PATENT DOCUMENTS

| | | | |
|---|---|---|---|
| 1,532,789 | 4/1925 | Vollrath . | |
| 2,279,267 | 4/1942 | Kremers | 148/8 |
| 2,608,980 | 9/1952 | Snyder et al. | 134/3 |
| 2,744,000 | 5/1956 | Seiler | 41/42 |
| 3,279,946 | 10/1966 | Schaarschmidt | 117/201 |
| 3,401,061 | 9/1968 | Watanabe | 134/22 |
| 3,436,261 | 4/1969 | Mitchell | 134/3 |
| 3,542,530 | 11/1970 | Talboom, Jr. et al. | 29/183.5 |
| 3,622,391 | 11/1971 | Baldi | 134/3 |
| 3,676,085 | 7/1972 | Evans et al. | 29/194 |
| 3,754,903 | 8/1973 | Goward et al. | 75/171 |
| 3,761,313 | 9/1973 | Entwisle et al. | 134/3 |
| 3,928,026 | 12/1975 | Hecht et al. | 75/134 |
| 4,055,705 | 10/1977 | Stecura etal. | 428/633 |
| 4,076,779 | 2/1978 | Skriletz | 264/39 |
| 4,098,450 | 7/1978 | Keller et al. | 228/119 |
| 4,159,917 | 7/1979 | Gluck | 148/1.5 |
| 4,248,940 | 2/1981 | Goward et al. | 427/419.2 |
| 4,264,374 | 4/1981 | Beyer etal. | 134/3 |
| 4,321,311 | 3/1982 | Strangman | 428/623 |
| 4,339,282 | 7/1982 | Lada et al. | 134/3 |
| 4,371,570 | 2/1983 | Goebel et al. | 427/248 |
| 4,405,659 | 9/1983 | Strangman | 427/250 |
| 4,410,697 | 8/1983 | Strangman | 427/250 |
| 4,425,185 | 1/1984 | Fishter et al. | 156/656 |
| 4,670,320 | 6/1987 | Yamaguchi et al. | 156/656 |

*Primary Examiner*—David L. Lacey
*Assistant Examiner*—Lori Ann Johnson
*Attorney, Agent, or Firm*—Charles E. Sohl

[57] ABSTRACT

Removal of ceramic thermal barrier coatings from metallic substrates is achieved by contacting the coated article with fluorine containing gas at an elevated temperature. The gas penetrates the ceramic to attack the interface between the substrate and ceramic causing the ceramic to spall.

7 Claims, No Drawings

GASEOUS REMOVAL OF CERAMIC COATINGS

This application is a continuation of Ser. No. 878,720 filed June 26, 1986, now abandoned.

CROSS-REFERENCE TO RELATED APPLICATION

Attention is directed to copending U.S. patent application Ser. No. 851,018, filed Apr. 1, 1986 now abandoned which discloses a similar method for a different purpose.

TECHNICAL FIELD

This invention relates to the removal of porous ceramic coatings from metallic substrates and has particular application to refurbishment of gas turbine engine hardware.

BACKGROUND ART

Gas turbine engine efficiency is closely related to operating temperatures and the continuing search for increased efficiency has been satisfied in part by substantial increases in gas turbine engine operating temperatures. Turbine engine internal gas temperatures now routinely exceed 2700° F. Since the melting point of commonly used superalloys is only about 2400° F., this high temperature operation is made possible only through the use of internal cooling. However even with internal cooling, hardware operating temperatures are reaching the material melting points. Additionally, the use of internal cooling detracts from engine efficiency in that the cooling air which originates in the compressor, which has some energy content is wasted air which could otherwise be used to support combustion. For these reasons ceramic thermal barrier coatings have been developed and are finding increasing applications. Such coatings were first used in the combustor section of gas turbine engines, but are now used in other applications.

Ceramic thermal barrier coatings are usually applied over a bond coat which is a highly oxidation resistant material such as an MCrAlY (see for example U.S. Pat. Nos. 3,542,530, 3,676,085, 3,754,903 and 3,928,026), or other oxidation resistant alloy as described in U.S. Pat. No. 4,371,570, column 3 lines 5–20. The ceramic coating is generally based on zirconia which is stabilized with additions of magnesia, yttria or other additives. Other ceramic materials such as alumina have also been proposed for ceramic coatings. The ceramic material is most often applied by plasma spraying (see U.S. Pat. No. 4,055,705, but may also be applied by vapor deposition as shown for example in U.S. Pat. No. 4,321,311. Both processes produce coatings containing 5–15% porosity, cracks and voids.

Ceramics are hard, durable, abrasion resistant materials and when it is necessary to remove a ceramic coating to rework a defective component during initial production or to refurbish parts after engine operation, it is extremely difficult to remove the ceramic coating without damaging the substrate. Insofar as is known the only practical method for removing ceramic coatings heretofore has been grit blasting in which abrasive particles are blown by compressed air against the ceramic surface to mechanically abrade the coating. This is a manual process since the process must be terminated immediately upon exposure of the substrate. Even in the hands of skilled operators however this is an inexact process which produces excessive amount of scrap parts.

Past attempts to use fluorine to remove ceramic coatings have (to my knowledge) involved the use of liquids containing HF. Aqueous HF is an exceptionally dangerous material which will produce severe burns even in low concentrations and short exposures. Equally significant however is the fact that aqueous solutions do not penetrate the coating but slowly dissolve the coating from the free surface inward. This aqueous dissolution attack produces sludge which must be periodically removed since it inhibits further reaction. Due to these limitations, use of aqueous HF is not a viable method to remove ceramic coatings.

One prior patent (U.S. Pat. No. 2,279,267) has suggested passing HF gas through a retort at room temperature to remove (nonporous vitreous enamel by general attack in a process requiring about 32 hours. The reaction is described as being principally betwen the HF and the $SiO_2$ enamel constituent. Other references deal with use of HF to descale metal and to clean semiconductor production apparatus. Use of gaseous HF to clear metal surfaces in preparation for brazing is also known.

Accordingly, it is an object of this invention to provide a method for the easy and economic removal of porous ceramic coatings from metallic substrates without significant substrate attack.

It is another object of the invention to provide a method for removing porous ceramic coatings from metallic substrates which will leave the substrates in a clean state free from oxides.

DISCLOSURE OF INVENTION

According to the present invention ceramic coated metallic components are exposed to gaseous hydrogen fluoride (or an equivalent fluorine source) at an elevated temperature. The coatings upon which the invention process is effective contain at least 5% and preferable at least 10% by volume of porosity to permit gas penetration of the coating. The fluorine containing gas penetrates the ceramic and preferentially attacks the interface between the bond coat and the coating. This interface consist of a thin oxide layer, arising for example during plasma spraying, which is doped with the metallic constituents of the substrate. The fluorine containing gas preferentially attacks this interface layer and causes the ceramic coating to spall from the substrate without significant reaction with the ceramic. Because of the preferential attack of the bond coat-ceramic interface, the process is an efficient user of fluorine and the excessive amounts of fluorine necessary to completely dissolve the coating are not necessary.

Use of gaseous fluorine is safe since the reaction occurs in a retort (since the coating spalls off, periodic removal of reaction products is unnecessary). After exiting the reaction the gases are scrubbed to remove fluorine and only nontoxic gases enter the atmosphere.

The attack of the interface is possible only because of coating porosity and use of fluorine atoms in the gas phase. Use of aqueous solutions containing fluoride ions has been attempted in the past but the liquid molecules attack only the exterior of the ceramic without penetrating the coating. The liquid phase approach also requires periodic scrubbing to remove reaction by products. It is not a commercially used process for these reasons.

The fluorine constituent is preferably provided in the form of hydrogen fluoride which is present in an amount from about 2% to about 10% by volume in a carrier gas which may be hydrogen or other carrier gas which is nonreactive with HF (and F) at the use temperature. Since it is known that hydrogen and fluorine react vigorously to form hydrogen fluorine it appears that an equivalent result could be obtained by mixing hydrogen with an appropriate amount of fluorine gas rather than using hydrogen fluoride, but there does not seem be any particular advantage in this approach. I also believe that fluorine could be mixed with a mixture of hydrogen and an inert gas (argon etc.) to produce a useful gas phase reactant.

It also seems entirely possible to dispense entirely with the hydrogen and use fluorine and a gas inert and nonreactive with fluorine. However, there are indications that HF is more reactive than $F_2$ a consequence of chemical bonding considerations. Use of $F_2$ rather than HF may require increased reactant concentrations.

The reaction between the gas and the coated substrate occurs at a temperature between about 1400° F. to about 2000° F. at substantially atmospheric pressure and requires from about 1 to about 4 hours for completion depending upon various process parameters. After removal of the coating the fluorine gas displaces the oxide layers and reacts with other contaminants which might otherwise be found on the surface of the metallic substrate producing a clean surface.

The foregoing, and other features and advantages of the present invention will become more apparent from the following description.

BEST MODE FOR CARRYING OUT THE INVENTION

As previously noted the invention involves reacting fluorine with the impure interface oxides between the substrate and a ceramic coating. I have used a mixture of hydrogen and hydrogen fluoride gas to accomplish this objective.

There are several related parameters in the process including gas concentration, temperature, pressure, ceramic coating thickness, ceramic coating porosity and the interface oxide layer composition. I have not made any parametric analysis of this process to determine all of the relationships between these parameters but it is clear that any skilled artisan will have no difficultly in adapting this process to the particular problem which may be at hand.

As general background information I believe that when using hydrogen fluoride gas and hydrogen that concentrations of from about 2% to about 10% of HF gas in hydrogen will be appropriate for reaction with magnesium stabilized zirconia coatings applied to MCrALy or other NiAl bond coated substrates in accordance with U.S. Pat. No. 4,248,940. Operating temperatures of from 1400° F.–2000° F. (preferably 1600° F.–1900° F.) and exposure times of 1–4 hours are appropriate and the reactant gas is held at essentially atmospheric pressure. It is clear that the vigor of the reaction will increase with increasing HF concentration, with increasing temperature, and with increasing pressure. Of course it is the nature of chemical reactions to be very sensitive to changes in temperature as the skilled artisan will appreciate.

The reaction vessel or retort may be fabricated from pure nickel which is relatively resistant to fluorine attack. Operation of the process at essentially atmospheric pressure simplifies the design and fabrication of the retort and minimizes leakage problems. However, there is no conceptual reason for limiting the process to atmospheric pressure.

The invention will be better understood by reference to the following illustrative examples.

EXAMPLE

Gas turbine engine hardware having a substrate comprised of IN 100 (nominal wt. % NiCoCrAlY composition 10 Cr, 15 Co, 5.5 Al, 4.7 Ti, 3 Mo, 1 V, 0.18 C, Bal. Ni) and a nominal 5 mil bond coating consisting essentially of 18 Cr, 23 Co, 12.5 Al, 0.3 Y, bal. Ni were coated with a 10 mil layer of magnesia stabilized zirconia material which was applied by plasma spraying and was approximately 80% dense. It was necessary to remove this ceramic coating so that the part could be refurbished and a new and uniform ceramic coating then reapplied. Ceramic removal was accomplished by placing the coated article in a nickel retort and heating the article to about 1800° F. while flowing a mixture of 95% by volume hydrogen, 5% by volume hydrogen fluoride through the retort at a space velocity of about 4 vols/hr. The retort was maintained at substantially atmospheric pressure and the process was continued for about 2 hours. At the end of this time the article was removed and the ceramic coating was found to have been completely removed and the part was bare and clean and ready to receive a new ceramic coating.

Although this invention has been shown and described with respect to detailed embodiments thereof, it will be understood by those skilled in the art that various changes in form and detail thereof may be made without departing from the spirit and scope of the claimed invention.

I claim:

1. A method for removing a ceramic coating from a metallic substrate, said coating containing at least 5% by volume of porosity, including comprising the steps of providing a metallic substrate having a porous ceramic coating, heating the coated substrate to a temperature between 1400° F. to 2000° F. while contacting the coated substrate with a gas mixture containing an amount of fluorine sufficient to attack the interface between the metallic substrate and the ceramic coating in preference to attacking the coating so as to thereby remove the ceramic coating by spallation without completely dissolving the coating and without significantly attacking the substrate, said coating removal occurring in less time than that required for complete coating dissolution under the same conditions.

2. A method as in claim 1 wherein the ceramic coating consists essentially of stabilized zirconia or alumina.

3. A method as in claim 1 wherein the gas contains an amount of fluorine equivalent to that found in a mixture containing 2% to 10% by volume hydrogen fluoride gas.

4. A method as in claim 1 in which the temperature is maintained between 1600° F. and 1900° F.

5. A method as in claim 1 wherein the reaction time is from about 1 to about 4 hours.

6. A method as in claim 2 wherein the fluorine constituent is present in the form of HF.

7. A method as in claim 1 wherein the gas mixture comprises 2–10 vol. % HF, with the balance hydrogen.

* * * * *